US007328710B2

(12) United States Patent
Hall et al.

(10) Patent No.: US 7,328,710 B2
(45) Date of Patent: Feb. 12, 2008

(54) HAIR RETENTION DEVICE AND METHOD OF USING SAME

(76) Inventors: Anne Hall, 12612 White Deer Dr., Littleton, CO (US) 80127; Jannine Crowley, 3112A W. Pikes Peak Ave., Colorado Springs, CO (US) 80904

( * ) Notice: Subject to any disclaimer, the term of this patent is extended or adjusted under 35 U.S.C. 154(b) by 434 days.

(21) Appl. No.: 10/881,109

(22) Filed: Jun. 29, 2004

(65) Prior Publication Data

US 2005/0039771 A1 Feb. 24, 2005

Related U.S. Application Data

(60) Provisional application No. 60/497,242, filed on Aug. 21, 2003.

(51) Int. Cl.
*A61K 7/13* (2006.01)
*A45D 20/08* (2006.01)
*A45D 8/04* (2006.01)

(52) U.S. Cl. ..... 132/208; 132/270; 132/273

(58) Field of Classification Search ..... 132/208, 132/246, 247, 248, 250, 261, 270, 273, 275, 132/280, 281, 282, 283, 284; 54/75, 76, 54/78; 24/300, 301, 454, 30.5 P, 17 B
See application file for complete search history.

(56) References Cited

U.S. PATENT DOCUMENTS

| | | | | | |
|---|---|---|---|---|---|
| 482,257 | A | | 9/1892 | Larkin | |
| 720,726 | A | * | 2/1903 | Mccarthy | 132/248 |
| 1,039,910 | A | * | 10/1912 | Degenhardt | 24/6 |
| 2,598,943 | A | * | 6/1952 | Solomon | 132/248 |
| 2,924,228 | A | | 2/1960 | McGee | 132/46 |
| 3,247,856 | A | | 4/1966 | Weeks | 132/46 |
| 3,623,190 | A | * | 11/1971 | Karass | 24/200 |
| 3,758,219 | A | * | 9/1973 | Stasio et al. | 402/80 L |
| 4,249,550 | A | * | 2/1981 | Cassidy | 132/252 |
| 4,892,110 | A | | 1/1990 | Harvie | 132/273 |
| 5,271,421 | A | | 12/1993 | Videtzky | 132/200 |
| 5,318,054 | A | * | 6/1994 | Neilson et al. | 132/273 |
| 5,458,109 | A | * | 10/1995 | Tu | 132/279 |
| 5,495,861 | A | | 3/1996 | Liberman | 132/273 |
| 5,799,842 | A | * | 9/1998 | Rumsey | 223/1 |
| 5,878,755 | A | | 3/1999 | Crabtree et al. | 132/273 |

(Continued)

OTHER PUBLICATIONS

Matel Barbie Hair Magic Instructions; 2002; 2 pp.

*Primary Examiner*—Todd E. Manahan
(74) *Attorney, Agent, or Firm*—Sheridan Ross PC

(57) ABSTRACT

A spiral or helical structure for retaining hair or hair-like strands is constructed from one or more rigid, semi-rigid, and/or flexible materials. Rigid or substantially rigid portions of the structure can be inter-spaced with flexible portions of similar spiral or helical structures to accommodate the ability to create desired bends, curves and/or curls. Elastomeric bands can be employed to secure the spiral or helical structures to hair strands, to other spiral or helical structures and/or other hair retention devices. Applying hair dye/stain to bundled hair within the spiral or helical structures provides an ability to "tie dye" hair strand bundles to create desired highlighting and/or hair coloring. The spiral or helical structure can be made of hollow or partially hollow material. Decorative items can be attached or interconnected to the various embodiments of the present invention. In a separate embodiment, an interior component is coupled with an outer component.

25 Claims, 4 Drawing Sheets

U.S. PATENT DOCUMENTS 6,267,120 B1 * 7/2001 Serignat ..... 132/273
D451,246 S * 11/2001 Zuckerman ..... D28/41
6,325,073 B1 * 12/2001 Di Maria Poole et al. .. 132/275
6,488,035 B2 * 12/2002 Sorsi ..... 132/275
6,758,221 B1 * 7/2004 Stachowski ..... 132/273
2004/0231689 A1 * 11/2004 Kobayashi et al. ..... 132/222

* cited by examiner

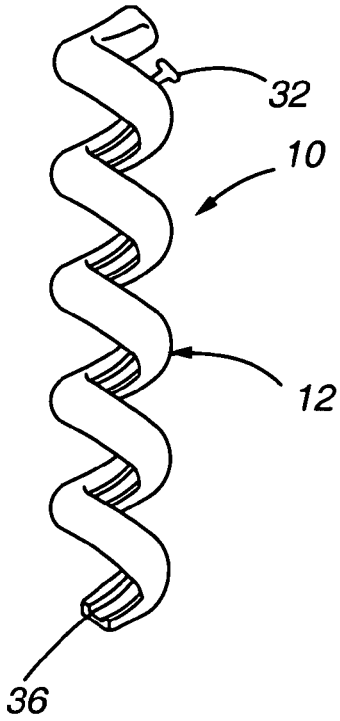
Fig. 9
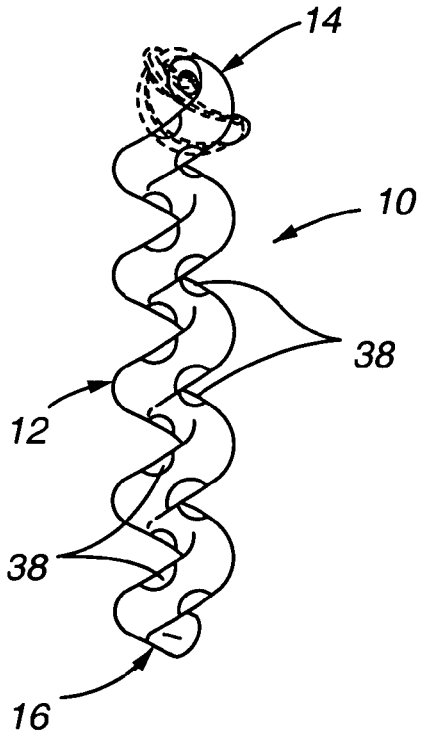
Fig. 10
Fig. 11
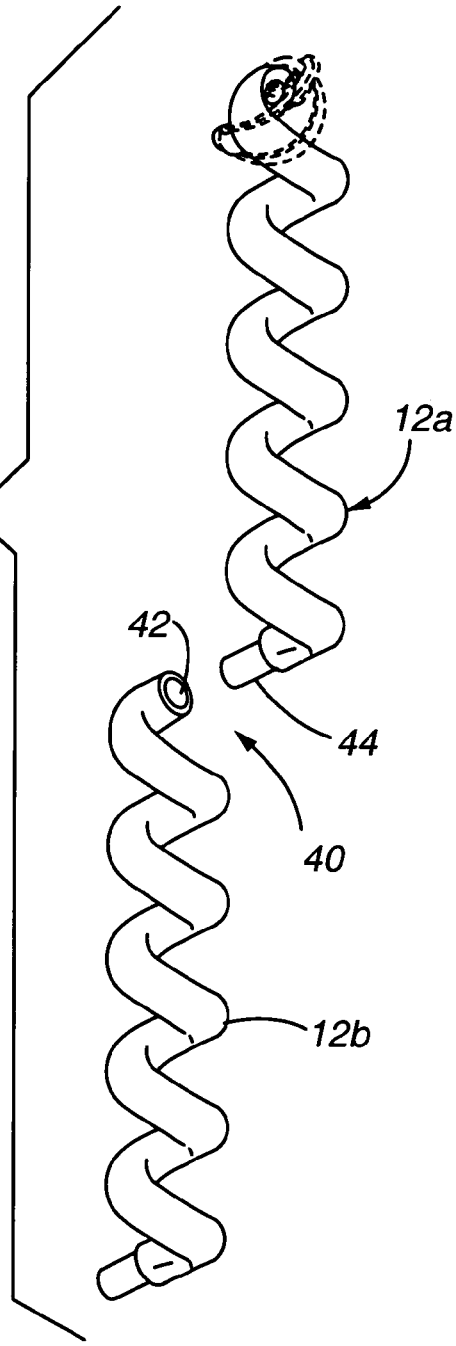

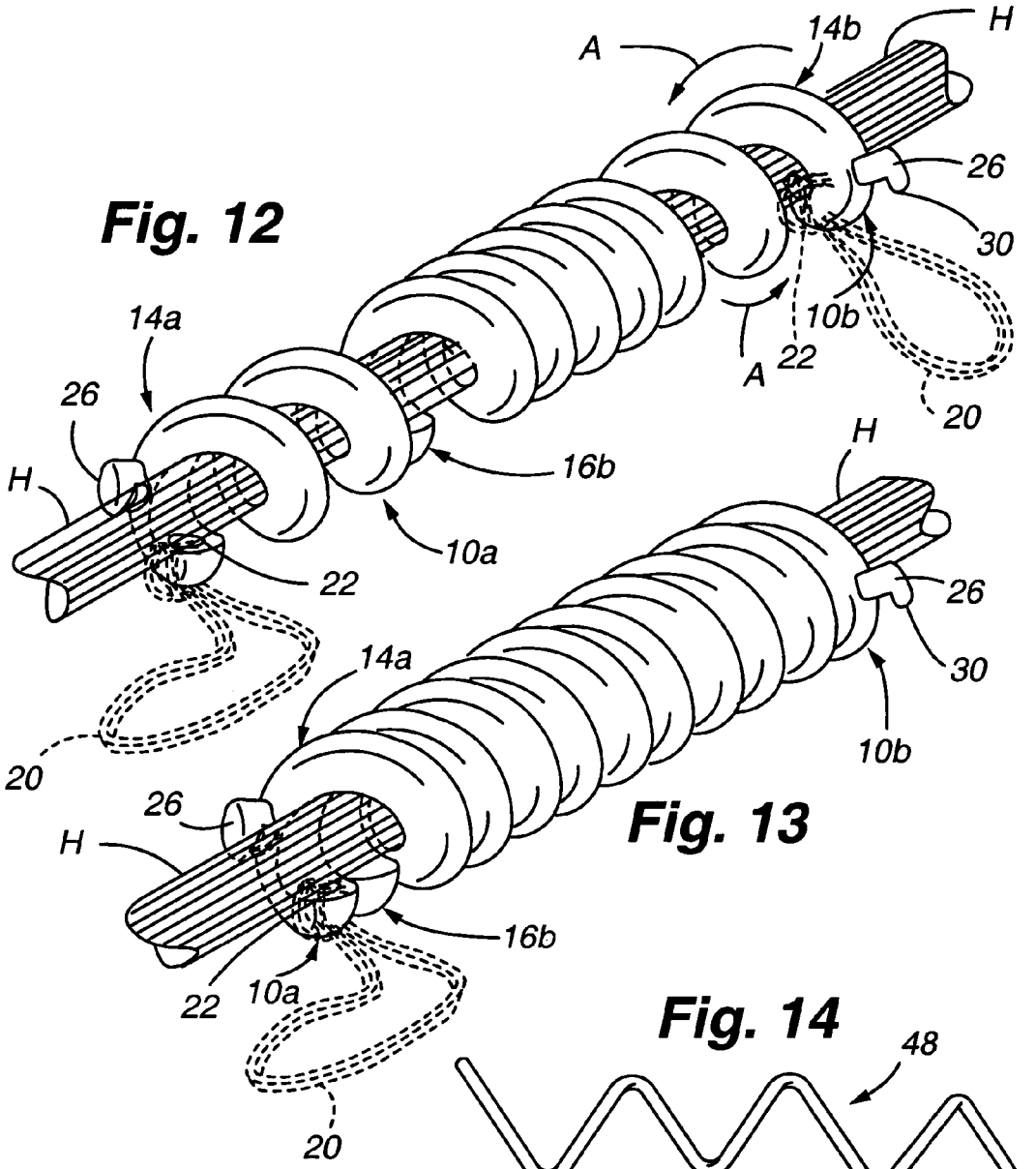
Fig. 12
Fig. 13
Fig. 14
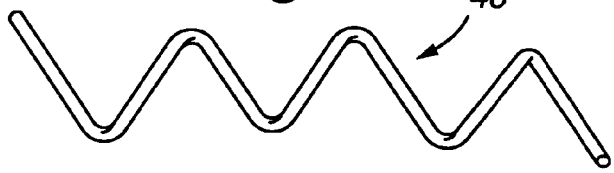
Fig. 15
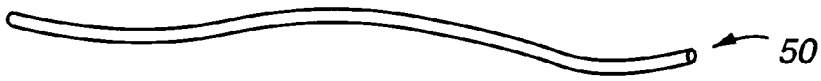
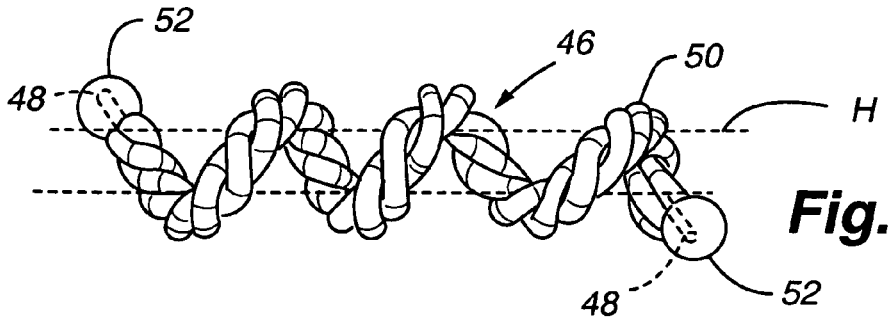
Fig. 16

HAIR RETENTION DEVICE AND METHOD OF USING SAME

CROSS-REFERENCE TO RELATED APPLICATIONS

Priority is claimed from U.S. Provisional Patent Application No. 60/497,242 filed Aug. 21, 2003 entitled "Hair Retention Device And Method of Using Same" which is incorporated herein by reference in its entirety.

FIELD OF THE INVENTION

The present invention is directed to a device for the retention hair or the restraining hair of humans and animals, and associated methods for using the device in restraining hair, as well as in dyeing and/or highlighting hair. Other aspects of the present invention are directed to restraining and/or dying other strand-like articles, such as strings, wires, shoelaces, backpack strings, etc.

BACKGROUND OF THE INVENTION

Devices for holding or ornamenting hair are well known. For example, U.S. Pat. No. 5,878,755 to Crabtree et al. is directed to a helical hair wrap device wherein the pitch openings between adjacent turns of the helix are larger than the inside diameter of the helix. The device is a one-piece design and is made of a short piece of rigid material that is not able to flex.

There exists a need for a hair retention device that, in some embodiments, is not necessarily of a unitary rigid design and that is not confined to particular pitch/diameter restrictions. Moreover, provision of a device that facilitates the retention of hair (or other strand material as discussed herein) within a generally spiral or helical configuration is desirable, especially if it has flexible characteristics, the ability to secure the ends thereof, is light weight, adjustable in length and/or adjustable with respect to other physical characteristics, etc. Additionally, methods of using a hair retention device in order to accomplish highlighting and/or dyeing of hair, and specifically the ability to "tie dye" hair, is a long-felt, but unsolved need.

SUMMARY OF THE INVENTION

One particular embodiment of the present invention is directed to a hair retention device comprising a substantially helical structure having a pitch opening or gap that is smaller than, equal to, or larger than the interior diameter of the helical structure. The helical structure is adapted to receive hair bundles within its interior diameter. The device includes an elastomeric band operatively associated with at least one end of the helical structure.

In a separate aspect of the invention, a hair retention device adapted to receive a bundle of human or animal hair is provided, wherein the device comprises a structure comprising a substantially spiral or a substantially helical shape. The structure has at least first and second ends, and the structure is adapted to receive the hair bundle by winding the hair bundle into an interior diameter of the structure. In addition, the device includes an elastomeric band operatively associated with the structure, wherein the elastomeric band is at least partially extended around the structure and the hair bundle and interconnected to the structure to hold the hair bundle to the structure.

It is a separate aspect of the present invention to provide alternate means for attaching the device to a bundle of hair. Thus, in a separate aspect of the invention, a hair retention device adapted to receive a bundle of human or animal hair is provided wherein the device comprises a substantially helical member adapted to receive the bundle of hair within an interior diameter. The device includes a flexible member interconnectable to the helical member, and the device further includes means for interconnecting the flexible member to the helical member, wherein the flexible member is at least partially extended around the helical member using the means for interconnecting, whereby the bundle of hair is held to the helical member.

Another embodiment of the present invention comprises a substantially helical member adapted to receive a bundle of hair within an interior diameter. The helical member comprises a rigid or semi-rigid interior component and a flexible exterior component encompassing at least a portion of the interior component.

A further embodiment of the present invention is directed to a method for dyeing a person's hair, comprising providing a helical structure that has a central opening that permits a bundle of hair to be accommodated therein; inserting a desired bundle of hair into the central opening of said helical structure; applying a hair dye to the hair within the helical structure; allowing the hair dye to reside on the hair for a desired period of time; and removing the helical structure from the hair bundle. Other embodiments of the present invention are set forth below.

Various embodiments of the present invention are set forth in the attached figures and in the detailed description of the invention as provided herein and as embodied by the claims. It should be understood, however, that this Summary of the Invention is not meant to be restrictive in any manner and that the invention as disclosed herein is and will be understood by those of ordinary skill in the art to encompass obvious improvements and modifications thereto.

BRIEF DESCRIPTION OF THE DRAWINGS

FIG. 9 is a perspective view that illustrates a separate embodiment wherein the helical structure is formed from a helical member having a groove running therethrough to further reduce weight, add to strength characteristics, etc.;

FIG. 10 is a perspective view illustrating one embodiment of the present invention wherein indentations are included throughout the helical structure to reduce the weight thereof;

FIG. 11 is a perspective view of one embodiment of the invention where separate helical structures are connected together at their ends in a telescoping/nesting relationship;

FIG. 12 is a perspective view of two devices of the present invention being intertwined;

FIG. 13 is a perspective view of a finished arrangement of the devices shown in FIG. 12;

FIG. 14 is a side elevation view of a interior core portion of a separate embodiment;

FIG. 15 is a side elevation view of an exterior or sheath portion of a separate embodiment; and FIG. 16 is a combination of the devices shown in FIGS. 14 and 15 to form yet a separate embodiment of the present invention.

Figure 1:
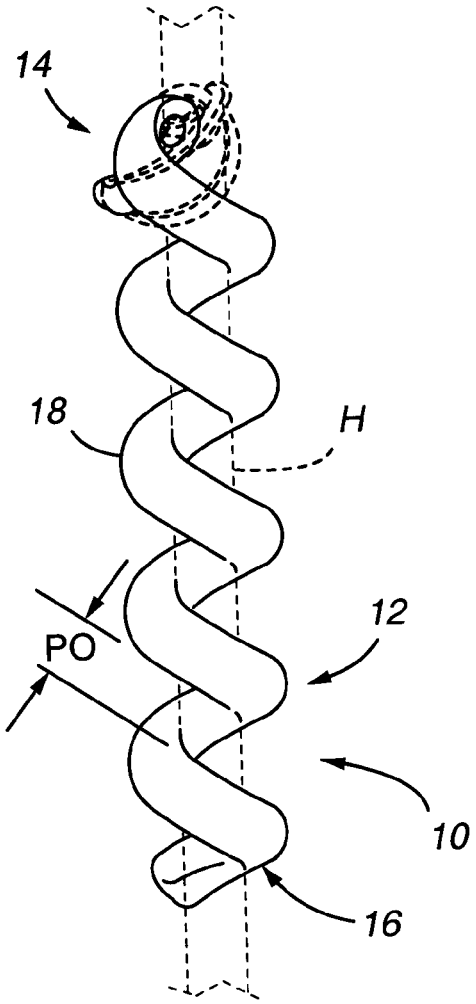
FIG. 1 is a perspective view of one embodiment of the present invention showing a helical structure with a connecting band associated with one end of the structure.
Figure 2:
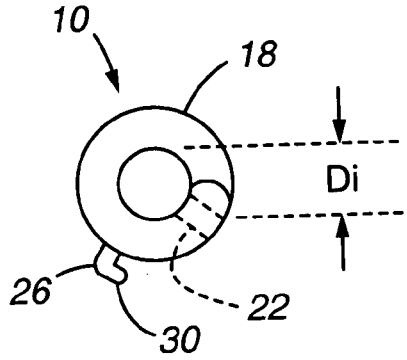
FIG. 2 is plan view of the helical member shown in FIG. 1.
Figure 4:
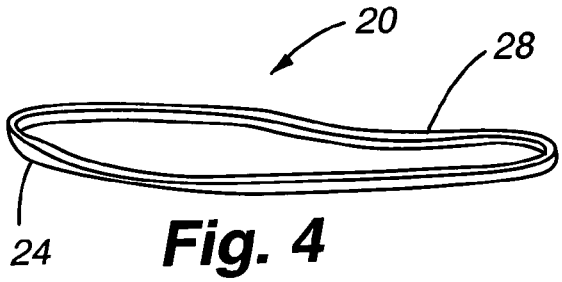
FIG. 4 is an elevation view of the elastomeric member portion of FIG. 1.
Figure 3:
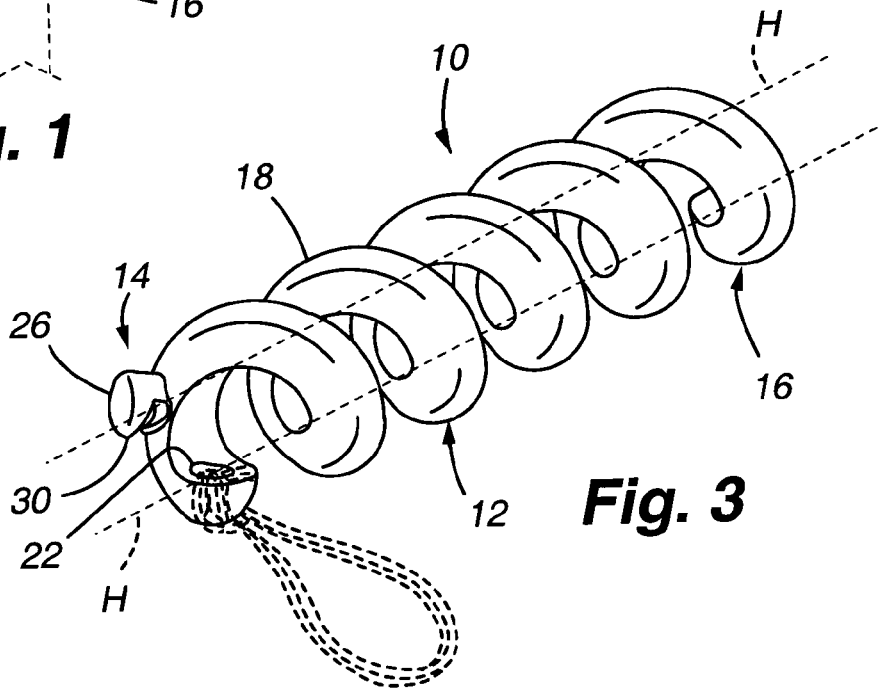
FIG. 3 is another perspective view of the device shown in FIG. 1.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which may be necessary to manufacture particular embodiments, such as conventional details of fabrication and assembly.

DETAILED DESCRIPTION OF VARIOUS EMBODIMENTS OF THE PRESENT INVENTION

The present invention is generally directed to a device having a generally helical or spiral configuration, such device facilitating the enclosure of a desired bundle of string-like or strand-like material, such as hair, within the confines of the device. In one particular embodiment, the spaced helical turns, defining a "pitch" of the helical structure, are not equally spaced apart. In other embodiments, the helical turns are equally spaced apart, and in still other embodiments, the diameter of the helix is either greater than, less than, or equal to the pitch openings of the helical structure. Other embodiments are directed to spiral or helical structures having varying diameters, pitches, number of turns per inch, etc., even within a certain length of a single device. In one particular embodiment, a hair bundle has a diameter greater than the pitch opening of the helical structure. It should be understood, however, that the present invention is not intended to be so limited. Indeed, the inventors incorporate by reference the disclosure in U.S. Pat. No. 5,878,755, which is incorporated in its entirely by this reference. The use of the particular structure shown in the '755 patent can be employed in other inventive embodiments of the present invention, including methods for dyeing and/or highlighting hair or other string-like structures (as described in more detail below).

In one particular embodiment of the present invention, the material utilized to manufacture the spiral or helical structure is rigid and/or semi-rigid. In other embodiments, however, rigid and/or semi-rigid lengths of a spiral or helical configuration are operatively associated with other lengths of less-rigid material. For example, in one embodiment, rigid and/or semi-rigid material forming the spiral or helical configuration is connected to a similar spiral or helical structure made from more flexible material. In such a manner, a user of the device is not necessarily relegated to having a straight length of spiral or helical configuration and instead, can "bend" the structure to accomplish unique and desired hairstyle designs. The material comprising the structure may therefore be metal, glass, ivory, ceramic, rubber, plastic, wood, composite material, or similar materials, or any combination thereof. Preferably, the material is plastic suitable for being manufactured from a mold.

Yet another aspect of the present invention relates to the provision of a "tying" device associated with at least one end of the spiral or helical structure. For example, a stretchable, elastomeric band (either circular or linear) is provided at substantially the end of one (or both) terminus of the spiral or helical structure, such band being stretchable and attachable either back to the spiral or helical structure itself, or to hair bands, other adjacent spiral or helical structures, and/or other hair retaining elements, etc. The elastomeric band itself can be operatively associated with the end of the spiral or helical structure by being threaded through one or more apertures at the end of the spiral or helical structure, or may be wrapped around peg-like structures that are connected to and/or integral with the spiral or helical structure. After hair is wrapped inside the structural spiral or helical features of the present invention, the elastomeric band(s) can be pulled around the back of the structure (preferably in the same direction that the spiral or helical structure is projecting) in order to loop the elastomeric band material around a button, peg, through an aperture, etc., in order to secure the hair band in a desired manner. The elastomeric band is preferably circular in shape, but may also be a simple length of straight material, etc., just as long as it performs the function of securing one end of the spiral or helical device in the hair. Other types of connecting elements can be utilized other than an elastomeric band. For example, more rigid clasps can be utilized at the ends or anywhere along the extent of the spiral or helical structure in order to accommodate the securement of hair bundle within the interior spiral or helical confines of the present device.

Still other embodiments of the present invention include the provision of a "knob" or "hook" of material situated at or within the central aspect of the spiral or helical structure. In other words, if one were to look through the center of the spiral or helical structure to the other end, a knob of material would appear at the far end of the central "hole" of the spiral or helical structure.

Referring now to FIGS. 1-4, a first embodiment of a hair retention device 10 of the present invention is illustrated. The hair retention device 10 preferably includes at least one structural member 12, where the structural member has a first end 14 and a second end 16. The structural member 12 preferably has a twisting or winding shape, and in at least one embodiment, the structural member 12 is a spiral or helical shape. The structural member 12 can include any number of rotations, and can have a uniform shape or can have a variable shape with uneven turns and irregular openings.

For the embodiment shown in FIGS. 1-4, the structural member 12 preferably comprises a substantially helical shape, and is formed of a single helical shaped member 18. The single helical shaped member 18 preferably has a constant inside diameter Di, where the inside of the single helical shaped member 18 substantially forms an open cylinder. As is known to those skilled in the art, a "pitch opening" is the opening or gap between turns on the helix. For the device shown in FIGS. 1-4, preferably the pitch opening PO can be either less than, equal to, or greater than the inside diameter Di, and more preferably, the pitch opening PO is greater than or equal to the inside diameter Di, and in one version of the present embodiment, the pitch opening PO is substantially equal to the inside diameter Di of the single helical shaped member 18.

The hair retention device 10 further includes an elastomeric member 20 that is interconnected to the single helical shaped member 18. More particularly, the elastic member 20 preferably comprises an endless elastomeric loop, or an elastomeric band that is attachable to the single helical shaped member 18. In one embodiment, the single helical shaped member 18 includes an aperture or hole 22 through which at least a first portion 24 of the elastomeric member 20 is placed. For example, for an elastomeric member 20 that is in the shape of an endless loop, as for example, a rubber band or an elastic band, the elastomeric member 20 can be interconnected to the single helical shaped member 18 by passing a portion of the elastomeric member 20 through the hole 22 such that a portion of the loop is present on either side of the member 18, and then taking one end of the elastomeric material and passing it through the opening in the loop of the elastomeric member on the other side of the hole and pulling the elastomeric member 20 snug. This method of interconnecting the elastomeric member 20 to the single helical shaped member 18 is essentially a larks neck knot. Alternatively, an elastomeric member 20 having a knot at one end can be interconnected by passing the unknotted end through the hole 22, such that the elastomeric member 20 is retained in the hole by the knotted end. In yet a different alternative, the elastomeric member 20 can be tied in a knot to the material surrounding the hole 22.

Still referring to FIGS. 1-4, preferably, the hair retention device 10 further includes a protrusion or projection 26 for receiving a second portion 28 of the elastomeric member 20 that is interconnected to the single helical shaped member 18. The projection 26 is preferably of a shape for retaining the second portion 28 of the elastomeric member 20. Accordingly, the projection 26 is preferably hook shaped or otherwise further comprises additional structure, such as a spur 30, that is positioned on the projection 26, and wherein the spur 30 acts as a barb for retaining the second portion 28 of the elastomeric member 20 when the second portion 28 is interconnected to the projection 26, such as by looping the second portion 28 over the spur 30 of the projection 26.

In use, the person using the hair retention device 10 winds all or a portion of a bundle or lock of hair H into the hair retention device 10 and then attaches the elastomeric member 20 to frictionally hold the lock of hair within the hair retention device 10. For example, for a retention device 10 that has a single helical shaped member 18, a lock of hair is separated and wound through at least one turn of the single helical shaped member 18. Next the elastomeric member 20 is looped around the lock of hair and interconnected to the single helical shaped member 18 to hold the hair in the device 10. More particularly, the elastomeric member 20 is interconnected to the single helical shaped member 18 using the projection 26 to hold a second portion 28 of the elastomeric member 20, where a first portion 24 of the elastomeric member 20 is interconnected to the single helical shaped member 18 by hole 22.

Figure 5:
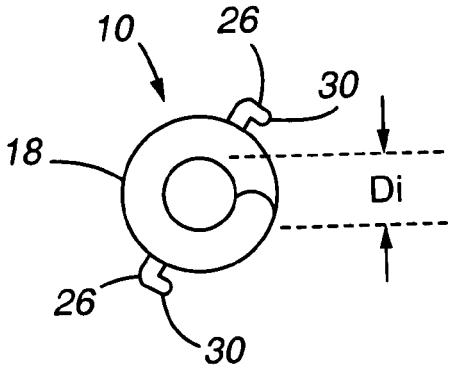
FIG. 5 is plan view of one embodiment of the present invention wherein attachment pegs or projections are operatively connected to opposite regions of a helical member.
Figure 6:
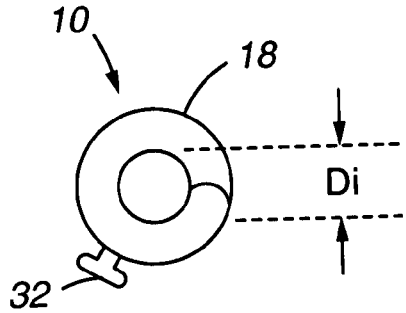
FIG. 6 is plan view of another embodiment of the present invention wherein a single attachment peg or projection is operatively connected to a helical member.

Alternatively, other means for interconnecting an elastomeric member 20 to the hair retention device 10 are possible. For example, as shown in FIG. 5, two projections may be used. That is, instead of a hole 22 and one projection 26, a single helical shaped member 18 having two separate projections 26 can be used. Alternatively, a single projection could be provided wherein the projection is shaped for retaining both first and second portions of the elastomeric member 20. For example, as shown in FIG. 6, a T-shaped projection 32 can be used, where one side of the T-shaped projection 32 retains a first portion 24 of the elastomeric member 20 and the second side of the T-shaped projection 32 retains a second portion 28 of the elastomeric member 20. Thus, a variety of means for retaining an elastomeric member 20 to the single helical shaped member 18 are possible, and are within the scope of the present invention. Furthermore, such means pertain to any hair retention device of the present invention, whether the structural member comprises, for example, a helical shaped member or spiral shaped member.

As shown in FIGS. 1-4, in one embodiment, the elastomeric member 20 is interconnected to the single helical shaped member 18 at one end of the single helical shaped member 18, that is, at either the first end 14 or the second end 16 of the single helical shaped member 18. Alternatively, the elastomeric member 20 may be interconnected to the single helical shaped member 18 at any position along single helical shaped member 18, including either the first or second ends 14 and 16.

In yet a different alternative, a plurality of elastomeric members may be used with a hair retention device. Indeed, one aspect of the present invention relates to the use of particular spiral/helical structures in bundling of horse manes and/or horse tails. For example, numerous spiral or helical structures can be used to bundle particularly desired diameters of hair from the mane of a horse, and various ornamental attachments can be associated with such bundles and/or with the spiral or helical structures retaining such bundles. In a embodiment for use with horse manes, rubber band-like connecting structures are associated with each end of the helical structures to further enhance the ability to secure the hair bundles to the spiral or helical structure itself. Thus, one aspect of the present invention has application in "braiding" a mane of a horse, where the present invention offers an alternative to traditional methods of braiding a horse's mane that can be relatively labor intensive, difficult, time consuming and/or expensive.

Figure 7:
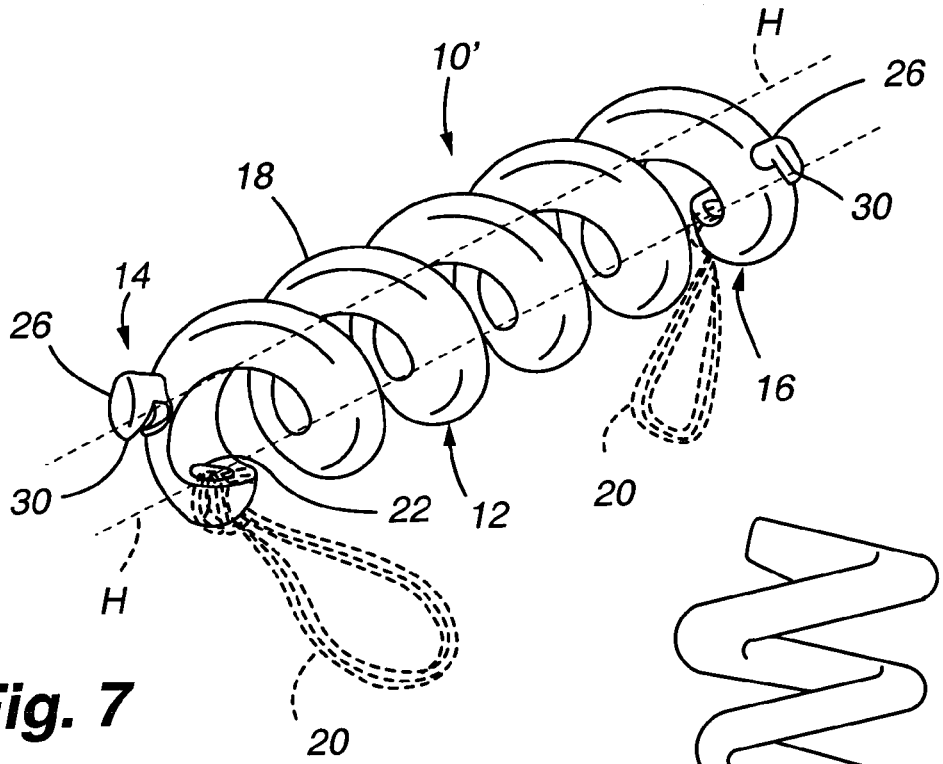
FIG. 7 is a perspective view of an alternate embodiment of the present invention having a plurality of elastomeric members.

Referring now to FIG. 7, a preferable embodiment for such a hair retention device 10' is shown, where the device comprises a structural member 12 used in combination with a plurality of elastomeric members 20, and more preferably, two elastomeric members 20. The device of FIG. 7 includes a first elastomeric member 20 positioned substantially at a first end 14 of the structural member 12, such as a single helical shaped member 18, and a second elastomeric member 20 positioned at substantially the other end or the second end 16 of the structural member 12. In use, the person "braiding" the horse's mane first winds all or portion of a bundle of hair into the hair retention device 10' and then attaches the elastomeric members 20. For example, for a retention device 10' that has single helical shaped member 18, a lock of hair is separated and wound through at least one turn of the single helical shaped member 18. Next a first elastomeric member 20 is looped around the lock of hair to hold the hair in the device 10'. More particularly, the first elastomeric member 20 is interconnected to the single helical shaped member 18 using a first projection 26 to hold a second portion 28 of the elastomeric member 20, where a first portion 24 of the elastomeric member 20 is interconnected to the single helical shaped member 18 by either a hole 22, a second projection 26, or a single projection such as a T-shaped projection 32, depending upon the structure of the hair retention device 10' that is employed. Subsequently, after winding the remaining portion of the lock of hair through the hair retention device 10', the second elastomeric member 20 is used in a manner similar to that described for the first elastomeric member 20. This method is repeated for the length of the horse's mane that is desired to be prepared.

The particular girth of any specific spiral or helical material can be varied depending on the particular use of the spiral or helical configuration. For example, the spiral or helical material (as opposed to the diameter of the spiral or helical structure formed by the spiraling/curling structure itself) can be as small as about 1/16th of an inch, more preferably about 1/8th of an inch, but also can be 1/4 of an inch or greater in girth. A larger diameter material accommodates a larger surface area upon which decorative or functional features can be imprinted, attached, applied and/or embodied.

Figure 8:
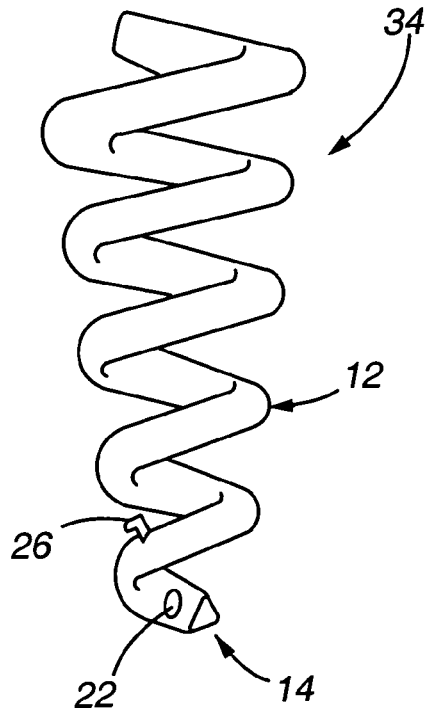
FIG. 8 illustrates a side view of one embodiment of the present invention wherein the material forming the structural member has a triangular cross section and wherein the diameter of the structural member varies from one end to the other in the form of a spiral.

As one will appreciate, the particular geometric shape of the material forming the spiral or helical member can vary. For example, instead of a round cross section of such material, such cross section can also be of any geometric configuration, such as a half moon, an oval, a triangle, a rectangle, a square, an octagon, etc. FIG. 8 depicts a hair retention device 34 that has a spiral shaped structural member 12, with a hole 22 and single projection 26, and wherein the cross section of the material forming the structural member 12 is substantially triangular in shape, as shown at first end 14.

Referring now to FIGS. 9 and 10, to facilitate the wearing of the present invention in a person's hair, especially when the girth of the material used is large, the spiral or helical structure can be made in a hollow or partially hollow configuration, thereby reducing the overall weight of the device. FIG. 9 depicts a hair retention device that includes a groove 36 along the interior portion of the structural member 12. Alternatively, as shown in FIG. 10, the spiral or helical device may have indentations, apertures, cavities or dimples 38 through the coiled/spiraled material at various places to further reduce the weight of the device. Other weight-lessening constructions are also included within the present invention, such as the provision of cavities, grooves, etc., in combination together.

The dimples 38 offer a location along the structural member 12 for adding decorative items, such as rhinestones. Alternatively, any of the embodiments of the present invention may include divots, slits, grooves, holes, indentations, etc. in the device that can be used to attach, glue, or otherwise interconnect jewels, decorations, suspended chains, etc. Additionally, a plurality of spaced apart hair retention devices of the present invention can be used to suspend a common decorative item. For example, although not shown, a first hair retention device can be interconnected to a first portion of a decorative item, such as chain made of faux or precious metals and/or jewels, and a second portion of the decorative item can be interconnected to a second hair retention device. Thus, decorative items can be strung from one hair retention device to another. Furthermore, other decorative items can be implanted, attached to the surface, or otherwise interconnected from any of the devices of the present invention. The decorative aspects disclosed herein and modifications thereof are within the scope of the present invention.

Referring now to FIG. 11, another aspect of the present invention includes the ability to interconnect different spiral or helical members in order to construct different length spiral or helical structures, and/or combine different pitch, number of turns per inch, girth of spiral or helical material, etc. with each other. For example, using a telescoping connector 40 comprising a female end 42 and a male end 44, the spiral/helical structures can be made so that their ends are telescopically connectable to the corresponding ends of other separate helical/spiral structures, thus permitting one to "build" longer length spiral or helical structures, including structures having rigidity/flexibility characteristics, color, and/or any one or more of the other attributes mentioned above. Each such interchangeable length of the structural member may include means for interconnecting an elastomeric member 20, such as the first structural member 12*a* shown in FIG. 11, or alternatively, the added section may not include the means for interconnecting an elastomeric member, such as the structural member 12*b*, also shown in FIG. 11.

Referring now to FIG. 12, in a yet a separate embodiment, two hair retention devices may be intertwined. For example, as shown in FIG. 12, a first hair retention device 10*a* is paired with a second hair retention device 10*b* by intertwining the two devices with each other and also around a bundle of hair H. The arrangement shown in FIG. 12 is of particular interest if contrasting devices and are used together. For example, first hair retention device 10*a* may be a first color and second hair retention device 10*b* may be a second color. Alternatively, the devices 10*a* and 10*b* may have different and/or complimentary surface finishes, features, and/or decorations.

In use, the first hair retention device 10*a* is interconnected to a bundle of hair H as previously described above. The second hair retention device 10*b* is then intertwined with the bundle of hair H associated with the first hair retention device 10*a*, and further intertwined with the first hair retention device 10*a*. The intertwining process is preferably achieved by turning the second hair retention device 10*b* into the first hair retention device 10*a*, such as by arrows A. Preferably, the structure of each device 10*a* and 10*b* is similar to the structure shown and described above for the device 10 shown in FIGS. 1 and 3.

In a separate aspect of this embodiment not shown, the first device 10*a* may include a hole 22 and elastic member 20, and the second device may include a projection 26 that receives the elastic member associated with the first device 10*a*. Thus, one device connects to the other via the elastic member. Thus, the elastic member connected to first end 14*a* of device 10*a*, may interconnect to the second end 16*b* of the second device 10*b*. Likewise, the elastic member connected to first end 14*b* of second device 10*b*, may be interconnected to the second end 16*a* of the first device 10*a*.

Referring now to FIGS. 14-16, yet a separate embodiment of the present invention is illustrated. Device 46 is a combination of at least two components, namely, an interior component 48 and an exterior component 50. FIG. 14 illustrates interior component 48, which is preferably a semi-rigid skeletal structural component of the device 46. Interior component 48 may be a rigid or semi-rigid material, such as stone, ceramic, metal, glass, rubber, plastic, or even organic material. As yet another example, the interior component may include one or more fluids contained in a casing, the one or more fluids having a number of possible characteristics, such as being a light emitting substance or a glow-in-the-dark material.

FIG. 15 illustrates exterior component 50. The exterior component 50 is preferably a flexible material that can be manipulated to form a covering or sheath for interior member 48. Exterior component 50 is preferably made of one or more of a cellophane, mesh, netting, rope, fabric, cloth, rubber, flexible plastic, foil, or similar material. The exterior component 50 may fit loosely or tightly over the interior component 48. The exterior component 50 is able to be manufactured or manipulated to substantially conform to the shape of the interior component 48. Preferably, during manufacture of device 46, interior component 48 is slid into exterior component 50, or exterior member 50 is otherwise applied or interconnected to the interior component 48.

Thus, device 46 is formed of a plurality of members and/or materials. For the example of the device 46 shown in FIG. 16, the exterior component 50 comprises a bundle of stands. However, it is to be understood that the exterior component 50 may be formed of a single sheath-like material, or it may be formed of a plurality of strands or items that form an exterior wrapping. The device 46 may also include a hole 22 and an elastic member 20 to interconnect to a projection 26 as described above, or the device 46 may not include these structures.

In use, if applied to a bundle of hair H, the hair H can be intertwined into the spiral or helical structure of the device 46 and an elastic member 20 (not shown in FIG. 16) applied if appropriate or desired. Alternatively, the device may be deformable and adaptable to frictionally engage a bundle of hair H or fiber without use of an elastic member 20.

The device 46 may also include one or more decorative members 52 at its ends, or it may have decorative items interwoven into, attached, or otherwise interconnected to it. The interior component 48 may or may not extend beyond one or both ends of the exterior component 50. For example, as shown in FIG. 16, the interior component 48 may extend beyond the ends of the exterior component 50 and into an interior of the decorative members 52.

In another aspect of the invention, the present invention can be used to create so-called "banana curls." Such curls are created by restraining particular hair bundles in a manner that permits large rounded curves of hair bundles to be formed without the traditional use of less cosmetically acceptable traditional hair rollers.

Still yet another aspect of the invention relates to a method of using one or more of the devices described herein in a method for tie-dyeing hair (or similar strand-like objects, e.g., shoe strings, etc.). In operation, the present method involves encircling bundles of hair within the spiral or helical structure of one or more devices of the present invention. Hair coloring dye is then applied to the hair as bundled, and a sufficient amount of dwell time is permitted prior to rinsing the hair dye from the person's hair. The spiral or helical device of the present invention is then removed to reveal hair strands that are alternately dyed and un-dyed, as desired. Various different styles can be accommodated using such a method, especially in view of the distinct types of devices that can be employed. For example, one can employ: different sized spiral or helical structures operatively associated with each other; rigid and flexible spiral or helical structures connected together and being capable of winding about each other and/or other objects, and; use of spiral or helical structures of varying pitch, diameter, number of turns, apertures within the structure to permit dye to pass therethrough, etc. A wide variety of different dyeing and/or highlighting techniques can be facilitated using the present device as will occur to one of ordinary skill in the art.

Another aspect of the present invention relates to the ability to attach desired articles to spiral or helical structures. For example, the spiral or helical structures of the present invention can be used to form a bridal headgear with flowers being attachable to the spiral or helical structure and/or interwoven with hair bundled by the spiral or helical structures, thereby presenting an ornamental desired effect. In addition, the spiral or helical structure itself can be configured so that it has ornamental designs included on the surface or attached thereto, such as a filigreed pattern, attachments of extending articles (e.g., leaves, flowers, various geometrical configurations extending from the spiral or helical structure and/or hanging down or projecting upwards therefrom) so as to create a desired style of hair decoration.

In a separate aspect of the present invention, the spiral or helical structure is provided in a desired length, "tight" spiral curl (e.g., desired pitch in relationship to the diameter of the spiral) in order to facilitate the formation of "dreadlock" structures. One of the long encountered difficulties in forming dreadlocks is that traditional methods involve the rather random clumping of hair together to form string-like mats of various sizes, configurations, etc. Using the present invention, it is possible to reversibly attach the spiral or helical structures of the present invention in order to form particular sized dreadlocks and to facilitate the cleaning of such dreadlocks without loss of desired hair bundle orientations.

Other embodiments of the present invention include the use of spiral/helix structures made from sponge-like material, such material being relatively porous, absorbent, lightweight and preferably bendable. This particular material may have preferable application when used with the hair dyeing method as disclosed herein since such sponge-like material can absorb and retain amounts of hair dye. In other words, whereas the present invention can be used as a shield to prevent hair coloring from contacting portions of the hair bundle underlying the spiral or helical structure, it can alternatively be used in a manner such that hair dye is applied to particular portions of the hair bundle underlying the spiral/helical structure (e.g., by using a helix made of absorbent material).

Still other embodiments of the present invention include spiral/helical structures that harden and/or become flexible under various conditions, such as hardening when dry, but becoming flexible when wet. Hair dryers and/or heaters can be used to facilitate a change in the rigidity and/or flexibility of particular helical/spiral structures, dependent upon what particular material is used to manufacture the same.

Yet another aspect of the present invention is directed to heated or heatable spiral or helical structures that can be used in a fashion similar to traditional "curlers." Instead of hair being wrapped about a cylindrical body, as in traditional curler uses, hair bundles are encircled by heated spiral or helical structures of the present invention, thereby providing the desired heat characteristics to dry such hair bundles in desired orientations. Indeed, in certain aspects of the present invention, long spiral or helical structures are provided with energy so as to adjust the heat emanating therefrom (e.g., spiral or helical structures can be associated with electrical devices when the spiral or helical structures are associated with bundles of hair).

The materials used to manufacture the spiral/helical structures can also be selected so that they are prone to change color in the sun and/or are suitable for increasing the amount of heat to particular hair bundles when exposed to sunlight, thus promoting the natural sun bleaching of hair.

The present invention also includes spiral/helical structures that glow in the dark, thus providing a cosmetic element when the present invention is worn at night, or under black lights, etc. The present invention can also be adapted so that it will light up, either by having luminescent materials added thereto, provided with light emitting diodes, etc., thus further enhancing the visual attractiveness and spectacle of wearing such device, especially in low light conditions.

While the majority of the above discussion focuses upon the retention of hair in the described spiral or helical structures, one of ordinary skill in the art will appreciate that the present invention has varied applications outside the field of hair retention and decoration. For example, the present invention finds application in restraining other strand-like articles, such as shoelaces, strings, wires, backpack strings, ropes, etc. The particular shapes, sizes, etc. of the invention as described for use with human hair can be readily adjusted to facilitate the use of the present invention in these other environments and for uses quite distinct from the retention of human hair. Moreover, the present invention is not restricted to the use with human hair, but also finds application when used with companion animals, such as pets.

While various embodiments of the present invention have been described in detail, it will be apparent that further modifications and adaptations of the invention will occur to those skilled in the art. It is to be expressly understood that such modifications and adaptations are within the spirit and scope of the present invention. Other aspects and embodiments of the present invention will occur to those of skill in the art upon review of the disclosure herein, and especially in view of the drawings included.

What is claimed is:

1. A hair retention device adapted to receive a bundle of human or animal hair, said device comprising:

a structure comprising a substantially spiral or a substantially helical shape, said structure having at least first and second ends, said structure further comprising a projection near said at least one of said first or second ends, said structure adapted to receive the hair bundle by winding the hair bundle into an interior diameter of said structure;

an elastomeric band operatively associated with said structure, wherein said elastomeric band is positioned near the same said at least one of said first or second ends as said projection and is at least partially extended around said structure and the hair bundle and interconnected to said structure to hold the hair bundle to said structure; and a hole in said structure located on the same said at least one of said first or second ends as said projection.

2. The device as claimed in claim 1, wherein said projection extends radially outward from an exterior surface of said structure.

3. The device as claimed in claim 1, wherein said projection further comprises a hook or a spur.

4. The device as claimed in claim 3, wherein said hook or said spur is sized to retain at least one portion of said elastomeric band.

5. The device as claimed in claim 1, wherein said structure comprises pitch openings that are equal to or larger than said interior diameter of said structure.

6. The device as claimed in claim 1, wherein said spiral or helical structure is a single spiral or a single helix.

7. The device as claimed in claim 1, further comprising a second projection near an other of said at least one of said first or second ends of said structure.

8. The device as claimed in claim 7, further comprising a second hole near said other of said at least one of said first or second ends of said structure.

9. The device as claimed in claim 8, further comprising a second elastomeric band operatively associated with said other of said at least one of said first or second ends of said structure.

10. The device as claimed in claim 1, wherein said substantially spiral shape is not symmetrical.

11. The device as claimed in claim 1, wherein at least one of said at least first and second ends of said structure tapers inward within said interior diameter of said structure.

12. The device as claimed in claim 1, further comprising first and second projections on said first or second ends, said elastomeric band connected to each of said first and second projections.

13. The device as claimed in claim 1, further comprising at least one receptacle in said structure for receiving an ornamental member.

14. A hair retention device adapted to receive a bundle of human or animal hair, said device comprising:

a structure comprising a substantially spiral or a substantially helical shape, said structure having at least first and second ends, said structure further comprising a projection near said at least one of said first or second ends, said structure adapted to receive the hair bundle by winding the hair bundle into an interior diameter of said structure;

an elastomeric band operatively associated with said structure, wherein said elastomeric band is positioned near the same said at least one of said first or second ends as said projection and is at least partially extended around said structure and the hair bundle and interconnected to said structure to hold the hair bundle to said structure; and wherein a first portion of said elastomeric band is interconnected to said structure by looping at least a portion of said elastomeric band through a hole, said hole located near the same said at least one of said first or second ends as said projection.

15. A hair retention device adapted to receive a bundle of human or animal hair, said device comprising:

a structure comprising a substantially spiral or a substantially helical shape, said structure having at least first and second ends, said structure further comprising a projection near said at least one of said first or second ends, said structure adapted to receive the hair bundle by winding the hair bundle into an interior diameter of said structure;

an elastomeric band operatively associated with said structure, wherein said elastomeric band is positioned near the same said at least one of said first or second ends as said projection and is at least partially extended around said structure and the hair bundle and interconnected to said structure to hold the hair bundle to said structure; and wherein a first portion of said elastomeric band is interconnected to said structure by knotting or tying said first portion of said elastomeric band to a hole located near the same said at least one of said first or second ends as said projection.

16. A hair retention device adapted to receive a bundle of human or animal hair, said device comprising:

a substantially helical member adapted to receive the bundle of hair within an interior diameter, said substantially helical member comprising at least one projection and at least one hole located near at least one first or second end of said substantially helical member;

a flexible member interconnectable to said helical member;

means for interconnecting said flexible member to said helical member;

wherein said flexible member is at least partially extended around said helical member using said means for interconnecting, whereby said bundle of hair is held to said helical member.

17. The device as claimed in claim 16, wherein said means for interconnecting comprises said at least one projection.

18. The device as claimed in claim 17, wherein said means for interconnecting comprises said at least one hole.

19. A hair retention device adapted to receive a bundle of human or animal hair, said device comprising:

a substantially helical structure, said helical structure comprising a single rigid or semi rigid member having first and second ends, said helical structure adapted to receive the hair bundle within an interior diameter, said structure including an outwardly facing projection near said first end of said structure, said projection comprising a hook or a spur, said helical structure including a hole located near said first end;

an elastomeric member interconnected to said helical structure near said first ends of said structure, wherein a first portion of said elastomeric member is interconnected to said first end of said structure by looping or knotting said first portion of said elastomeric member through said hole, and wherein a second portion of said elastomeric member is interconnected to said helical structure by attaching said second portion to said projection;

wherein said elastomeric member is at least partially extended around said helical structure and the hair bundle to hold the hair bundle to said structure.

20. The device as claimed in claim 19, further comprising a second projection near said second end of said structure.

21. The device as claimed in claim 20, further comprising a second elastomeric band, said second elastomeric band operatively associated with said second end of said structure.

22. A method for dyeing a person's hair, comprising:

(a) providing a helical structure that has a central opening that permits a bundle of hair to be accommodated therein;

(b) inserting a desired bundle of hair into said central opening of said helical structure;

(c) applying a hair dye to said hair within said helical structure;

(d) allowing said hair dye to reside on said hair for a desired period of time; and (e) removing said helical structure from said hair bundle.

23. The method as claimed in claim 22 wherein said helical structure comprises at least one projection and at least one hole located near a first end of said helical structure.

24. The method as claimed in claim 22 wherein said at least one projection further comprises a hook or a spur.

25. The method as claimed in claim 22 wherein said helical structure further comprises a second projection near said second end of said structure.

* * * * *